United States Patent [19]

Hodgson et al.

[11] Patent Number: 4,909,925

[45] Date of Patent: Mar. 20, 1990

[54] REMOVAL OF HYDROGEN SULPHIDES

[75] Inventors: Philip K. G. Hodgson, Walton-on-Thames; Julie A. McShea, Shepperton; Edward J. Tinley, Farnham, all of England

[73] Assignee: The British Petroleum Company p.l.c., London, England

[21] Appl. No.: 325,120

[22] Filed: Mar. 20, 1989

Related U.S. Application Data

[63] Continuation of Ser. No. 7,477, Jan. 28, 1987, abandoned.

[30] Foreign Application Priority Data

Jan. 30, 1986 [GB] United Kingdom ..... 8602320

[51] Int. Cl.[4] ..... C106 27/00

[52] U.S. Cl. ..... 208/189; 208/47; 208/204; 208/206; 208/207; 208/236; 208/208 R; 208/237; 208/240; 252/396; 423/244; 423/270; 423/224; 166/265; 166/267; 175/64

[58] Field of Search ..... 208/236, 237, 240, 47, 208/204, 206, 208 R, 189; 423/244, 270, 224; 166/224 R, 265, 267, 902, 300, 301; 175/64; 252/396

[56] References Cited

U.S. PATENT DOCUMENTS

| | | | |
|---|---|---|---|
| 2,069,329 | 2/1934 | Roelfsema | 208/236 |
| 2,162,963 | 6/1939 | McKiltrick | 208/236 |
| 3,023,160 | 2/1962 | Stedman | 208/240 |
| 3,072,566 | 1/1963 | Makin, Jr. | 208/236 |
| 3,197,400 | 7/1965 | Fierce et al. | 208/236 |
| 3,382,031 | 5/1968 | Cox | 208/236 |
| 4,297,206 | 10/1981 | Scheibel | 208/236 |
| 4,414,103 | 11/1983 | Farrell | 208/254 H |
| 4,556,111 | 12/1985 | Wu et al. | 166/310 |
| 4,569,766 | 2/1986 | Korol et al. | 210/690 |
| 4,680,127 | 7/1987 | Edmondson | 423/243 X |

*Primary Examiner*—Helane Myers

*Attorney, Agent, or Firm*—Morgan & Finnegan

[57] ABSTRACT

Hydrogen sulphide is scavenged from a feedstock comprising crude oil and hydrogen sulphide by adding a compound of general formula

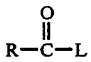

to the feedstock. R is an alkyl group containing 1 to 18 carbon atoms, an aryl group, or an alkyl aryl group wherein the alkyl moiety contains 1 to 18 carbon atoms and L is a leaving group.

Preferred scavengers include acetic anhydride and triacetamide.

7 Claims, No Drawings

REMOVAL OF HYDROGEN SULPHIDES

This is a continuation of co-pending application Ser. No. 07/007,477, filed on Jan. 28, 1987, abandoned.

This invention relates to a method for removing hydrogen sulphide from crude oil.

A petroleum reservoir is formed by a suitably shaped porous stratum of rock sealed with an impervious rock. The nature of the reservoir rock is extremely important as the oil is present in the small spaces or pores which separate individual rock grains.

Crude oil is generally found in a reservoir in association with water, which is often saline, and gas. Dependent upon the characteristics of the crude, the temperature and the pressure, the gas may exist in solution in the oil or additionally as a separate phase in the form of a gas cap. The oil and gas occupy the upper part of the reservoir and below there may be a considerable volume of water, known as the aquifer, which extends throughout the lower levels of the rock.

For oil to move through the pores of the reservoir rock and into a well, the pressure under which the oil exists in the reservoir must be greater than the pressure at the well.

The water contained in the aquifer is under pressure and is one source of drive. The dissolved gas associated with the oil is another and so is the free gas in the gas cap when this is present.

When oil is produced from a well, it is forced from the reservoir by natural pressure to the bottom of the well up which it rises to the surface. As the oil rises the pressure becomes less and gas associated with the oil is progressively released from solution.

After emerging from the well, it is necessary to treat the multi-phase mixture of oil, gas and possibly water, hereinafter termed "produced well fluid", in separators to remove free or potentially free gas, mainly methane and ethane. By potentially free gas is meant gas which would be likely to come out of solution if the oil were maintained at about atmospheric pressure, for example, during transport in a tanker or in storage tanks, without treatment.

Some crude oils contain not only dissolved hydrocarbon gases, but also appreciable quantities of hydrogen sulphide. This problem is particularly associated with "watered out" reservoirs approaching the end of their life, although it is not confined to them.

Hydrogen sulphide is a toxic, evil-smelling and corrosive gas and is unacceptable in quantity from both safety and environmental considerations. When hydrogen sulphide is present, it is necessary to provide further treatment to reduce the concentration of hydrogen sulphide in all products to an acceptably low level.

Much of the hydrogen sulphide associates with the gases resulting from the gas-oil separation process and this may be removed by scrubbing the gases, for example with amines. This requires expensive gas/liquid contacting, regeneration and conversion facilities. The cost of this extra treatment is considerable and in some cases, e.g., offshore fields, gas scrubbing may not be feasible since space may not be available on the field platforms for retrofitting the necessary equipment.

Even where gas scrubbing is possible, this still leaves some hydrogen sulphide associated with the oil and aqueous phases, however, It would clearly be more convenient to treat the produced well fluid with a scavenger for hydrogen sulphide before the various phases are separated.

We have now discovered that certain compounds containing electrophilic acyl groups are capable of reacting with hydrogen sulphide under mixed phase conditions and forming relatively harmless thiol compounds.

Thus according to the present invention, there is provided a method for scavenging hydrogen sulphide from a feedstock comprising crude oil and hydrogen sulphide which method comprises adding a compound of general formula:

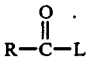

wherein R is an alkyl group containing 1 to 18 carbon atoms, an aryl group, or an alkyl aryl group wherein the alkyl moiety contains 1 to 18 carbon atoms and L is a leaving group to the feedstock and allowing the compound to react with the hydrogen sulphide contained therein.

By a leaving group is meant a group readily displaced by hydrogen sulphide or its anion.

Preferred leaving groups include carboxylate anhydride and amide. Other suitable leaving groups include halide and phenoxide.

The feedstock may be produced well fluid as hereinbefore defined.

Although the above defined scavengers are particularly useful in treating produced well fluids since they can withstand the severe environments of the latter, they are also suitable for treating crude oil or petroleum fractions under milder conditions, for example in pipelines, storage tanks, railcars, tankers, etc., after the well fluid has been dewatered and degassed.

When water is present, the partitioning of hydrogen sulphide between the various phases depends largely upon the pH and redox potential of the aqueous phase. These will normally be such that the hydrogen sulphide is concentrated in the oil and aqueous phases, (i.e., in the ranges 4 to 9.5 and −0.2 to −0.3 V with reference to hydrogen potential, respectively.

Preferably the scavengers are oil soluble and react with the hydrogen sulphide in the oil phase. By mass transfer this also reduces the concentration of hydrogen sulphide in the gaseous and aqueous phases. The oil soluble scavengers should also be stable in the presence of water and thermally stable since well fluids are often produced at elevated temperature.

Suitable scavengers include

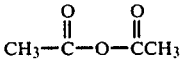

acetic anhydride

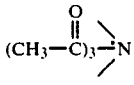

triacetamide

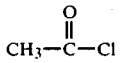

acetyl chloride

The scavenger is suitably used in amount 1 to 50, preferably 5 to 15, times the amount of hydrogen sulphide present, on a molar basis.

The length of time required to scavenge the hydrogen sulphide is generally of the order of 1 minute to 24 hours.

The invention is illustrated with reference to the following Examples.

EXAMPLES 50 g crude oil (from the Nettleham B reservoir in the English Midlands) and 10 g distilled water were sparged with gaseous hydrogen sulphide and introduced into an autoclave. In Examples 1 and 3, no scavenger was added. In Examples 2, 4, 5 and 6 scavenger was added in the amounts specified. The autoclave was sealed and allowed to equilibrate for a specified time at a desired temperature. The gas above the oil/aqueous phase was then withdrawn and bubbled slowly through a known volume of 3% borax solution.

The autoclave was then charged to 5 bar pressure with nitrogen. This action sparged more hydrogen sulphide from the oil/aqueous phase. After 5 minutes the gas above the oil/aqueous phase was withdrawn and bubbled through the same borax solution. The amount of hydrogen sulphide collected in the borax as $SH^-$ and $S^{2-}$ ions was determined by standard iodine titrations.

The amount of hydrogen sulphide recovered was then compared with the amount introduced.

The following results were obtained.

| Ex | Temp °C. | Scavenger | pH of Aqueous Phase | $H_2S$ Introduced (g) | Equilibration Time (Hours) | $H_2S$ Recovered (% by wt) |
|---|---|---|---|---|---|---|
| 1 | 60 | None | 2 | 0.072 | 2 | 56.5 |
| 2 | 60 | Acetic anhydride (0.35 g) | 2 | 0.070 | 2 | 35 |
| 3 | 25 | None | 6 | 0.025 | 2 | 55.4 |
| 4 | 25 | Acetic anhydride (0.35 g) | 6–7 | 0.017 | 16 | 27.4 |
| 5 | 25 | Triacetamide (0.1 g) | 6 | 0.018 | 2 | 45.3 |
| 6 | 25 | Triacetamide (0.1 g) | 6 | 0.013 | 20 | 35 |

We claim:

1. A method for removing hydrogen sulphide from a feedstock comprising crude oil and hydrogen sulphide and converting it to a thiol compound which remains in the crude oil which method consists essentially of adding a compound of general formula:

$$R-\overset{\overset{\displaystyle O}{\|}}{C}-L$$

wherein R is an alkyl group containing 1 to 18 carbon atoms, an aryl group, or an alkyl aryl group wherein the alkyl moiety contains 1 to 18 carbon atoms and L is a leaving group selected from the group consisting of carboxylate anhydride, amide, halide or phenoxide, to the feedstock in amount 1 to 50 times the amount of hydrogen sulphide present on a molar basis and reacting the compound in the liquid phase with the hydrogen sulphide contained therein at the production temperature of the crude oil or below this temperature.

2. A method according to claim 1 wherein the leaving group is carboxylate anhydride or amide.

3. A method according to claim 1 wherein the leaving group is halide or phenoxide.

4. A method according to claim 1 wherein the compound is acetic anhydride or triacetamide.

5. A method according to claim 1 wherein the feedstock is produced well fluid.

6. A method according to claim 1 wherein the feedstock is dewatered or degassed crude petroleum.

7. A method according to claim 1 wherein the compound is used in amount 5 to 15 times the amount of hydrogen sulphide present, on a molar basis.

* * * * *